US009879525B2

(12) United States Patent
Morrow et al.

(10) Patent No.: US 9,879,525 B2
(45) Date of Patent: Jan. 30, 2018

(54) SYSTEMS AND METHODS FOR MONITORING A CONDITION OF A TUBULAR CONFIGURED TO CONVEY A HYDROCARBON FLUID

(71) Applicants: Timothy I. Morrow, Humble, TX (US); Mark M. Disko, Glen Gardner, NJ (US)

(72) Inventors: Timothy I. Morrow, Humble, TX (US); Mark M. Disko, Glen Gardner, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 139 days.

(21) Appl. No.: 14/820,612

(22) Filed: Aug. 7, 2015

(65) Prior Publication Data

US 2016/0090834 A1 Mar. 31, 2016

Related U.S. Application Data

(60) Provisional application No. 62/055,959, filed on Sep. 26, 2014.

(51) Int. Cl.
*E21B 47/12* (2012.01)
*E21B 47/00* (2012.01)

(52) U.S. Cl.
CPC ..... *E21B 47/12* (2013.01); *E21B 47/0006* (2013.01)

(58) Field of Classification Search
CPC ..... E21B 47/0006; E21B 47/12
USPC .... 166/53, 250.01; 340/853.2, 856.3, 855.5; 367/82
See application file for complete search history.

(56) References Cited

U.S. PATENT DOCUMENTS 5,995,449 A 11/1999 Green et al.
6,324,904 B1 12/2001 Ishikawa et al.
6,474,165 B1 * 11/2002 Harper ..... G01N 29/2487 73/623

(Continued)

FOREIGN PATENT DOCUMENTS

EP 1 467 060 A1 10/2004
EP 2 194 227 A2 6/2010

(Continued)

*Primary Examiner* — Steven Lim
*Assistant Examiner* — Mancil Littlejohn, Jr.
(74) *Attorney, Agent, or Firm* — ExxonMobil Upstream Research Company—Law Department

(57) ABSTRACT

Systems and methods for monitoring a condition of a tubular configured to convey a fluid such as for use in producing hydrocarbons in relationship with a hydrocarbon system related wellbore operation. The methods include transmitting a data signal along the tubular with the communication network. The methods may include initiating a tubular operation responsive to the data signal indicating that the condition of the tubular is outside a predetermined condition range. The methods may include transmitting the data signal by propagating the data signal along the tubular via a plurality of node-to-node communications between communication nodes of the communication network and monitoring a signal propagation property of the plurality of node-to-node communications that is indicative of the condition of the tubular. The methods may include detecting the condition of the tubular and generating a condition indication signal.

27 Claims, 6 Drawing Sheets

(56) References Cited

U.S. PATENT DOCUMENTS

| | | | | |
|---|---|---|---|---|
| 6,899,178 | B2 | 5/2005 | Tubel | |
| 6,956,791 | B2 | 10/2005 | Dopf et al. | |
| 6,980,929 | B2 | 12/2005 | Aronstam et al. | |
| 7,249,636 | B2 | 7/2007 | Ohmer | |
| 7,385,523 | B2 | 6/2008 | Thomeer et al. | |
| 7,411,517 | B2 | 8/2008 | Flanagan | |
| 8,237,585 | B2 | 8/2012 | Zimmerman | |
| 8,544,564 | B2 | 10/2013 | Moore et al. | |
| 8,683,859 | B2 | 4/2014 | Godager | |
| 8,689,621 | B2 | 4/2014 | Godager | |
| 8,826,980 | B2 | 9/2014 | Neer | |
| 8,833,469 | B2 | 9/2014 | Purkis | |
| 2003/0151977 | A1* | 8/2003 | Shah | E21B 47/122 367/82 |
| 2005/0284659 | A1 | 12/2005 | Hall et al. | |
| 2011/0186290 | A1 | 8/2011 | Roddy et al. | |
| 2013/0192823 | A1 | 8/2013 | Barrilleaux et al. | |
| 2013/0248172 | A1 | 9/2013 | Angeles Boza et al. | |
| 2014/0152659 | A1 | 6/2014 | Davidson et al. | |
| 2014/0166266 | A1 | 6/2014 | Read | |
| 2014/0266769 | A1 | 9/2014 | van Zelm | |
| 2014/0327552 | A1 | 11/2014 | Filas et al. | |
| 2014/0352955 | A1 | 12/2014 | Tubel et al. | |
| 2015/0003202 | A1 | 1/2015 | Palmer et al. | |
| 2015/0009040 | A1 | 1/2015 | Bowles et al. | |
| 2015/0027687 | A1 | 1/2015 | Tubel | |
| 2015/0143920 | A1* | 5/2015 | Mackenzie | G01B 13/10 73/861.52 |
| 2015/0285065 | A1* | 10/2015 | Howell | E21B 47/0005 367/82 |

FOREIGN PATENT DOCUMENTS

| | | | |
|---|---|---|---|
| WO | WO 2013/079928 | A2 | 6/2013 |
| WO | WO 2013/112273 | A2 | 8/2013 |
| WO | WO 2014/018010 | A1 | 1/2014 |
| WO | WO 2014/049360 | A2 | 4/2014 |
| WO | WO 2014/100266 | A1 | 6/2014 |
| WO | WO 2014/100272 | A1 | 6/2014 |
| WO | WO 2014/134741 | A1 | 9/2014 |

* cited by examiner

SYSTEMS AND METHODS FOR MONITORING A CONDITION OF A TUBULAR CONFIGURED TO CONVEY A HYDROCARBON FLUID

CROSS-REFERENCE TO RELATED APPLICATION

This application claims the benefit of U.S. Provisional Patent Application 62/055,959, filed Sep. 26, 2014, entitled "Systems and Methods for Monitoring a Condition of a Tubular Configured to Convey a Hydrocarbon Fluid," the entirety of which is incorporated by reference herein.

FIELD OF THE DISCLOSURE

The present disclosure is directed generally to systems and methods for monitoring a condition of a tubular that is configured to convey a hydrocarbon fluid, and more particularly to systems and methods that utilize a communication network to monitor the condition of the tubular.

BACKGROUND OF THE DISCLOSURE

A tubular, such as a pipeline, a casing string, a tubing string, and/or the like, may be utilized to convey a hydrocarbon fluid. Over an operational lifetime of the tubular, the condition of the tubular may change due to a variety of factors. As examples, the tubular may corrode, such as due to chemical interactions with fluids that may be in contact with the tubular, and/or may be eroded away, such as due to a flow of particulate materials within a tubular conduit that is defined by the tubular. As an additional example, a portion of the tubular conduit may be restricted, such as due to buildup of scale, hydrates, wax, and/or asphaltenes within the tubular conduit.

Historically, changes in the condition of the tubular may not be detected without direct intervention within the tubular conduit. For example, a caliper, camera, and/or other logging tool may be inserted into the tubular conduit and conveyed along a length of the tubular conduit to assess the condition of the tubular and/or to quantify blockage of the tubular conduit. While such a detection methodology may be effective at detecting some changes in the condition of the tubular and/or blockage of the tubular conduit, it may be necessary to cease production and/or other flow of the hydrocarbon fluid within the tubular conduit to permit insertion of the logging tool into the tubular conduit. In addition, the costs and difficulties associated with these detection methodologies may preclude their frequent use. Thus, there exists a need for improved systems and methods for monitoring the condition of a tubular that is configured to convey a hydrocarbon fluid.

SUMMARY OF THE DISCLOSURE

Systems and methods for monitoring a condition of a tubular that is configured to convey a hydrocarbon fluid. The systems include a hydrocarbon fluid conveyance system that includes the tubular, a communication network, and a controller programmed to perform the methods.

The methods may include transmitting a data signal along the tubular with the communication network and initiating a tubular operation responsive to the data signal indicating that the condition of the tubular is outside a predetermined condition range. The communication network may include a plurality of communication nodes.

The methods may include transmitting the data signal by propagating the data signal along the tubular via a plurality of node-to-node communications of the plurality of communication nodes and monitoring a signal propagation property of the plurality of node-to-node communications that is indicative of the condition of the tubular. Each of the plurality of communication nodes may be configured to receive an input data signal and to generate an output data signal that is based, at least in part, on the input data signal. Each of the plurality of node-to-node communications may include transmission of a respective output data signal by a given communication node of the plurality of communication nodes and receipt of the respective output data signal, as a respective input data signal, by another communication node of the plurality of communication nodes.

The methods may include detecting the condition of the tubular with a tubular condition detector, generating a condition indication signal with the tubular condition detector, and transmitting the data signal along the tubular with the communication network. The condition indication signal may be indicative of the condition of the tubular, and the data signal may be based, at least in part, on the condition indication signal.

DETAILED DESCRIPTION AND BEST MODE OF THE DISCLOSURE

Figure 1:
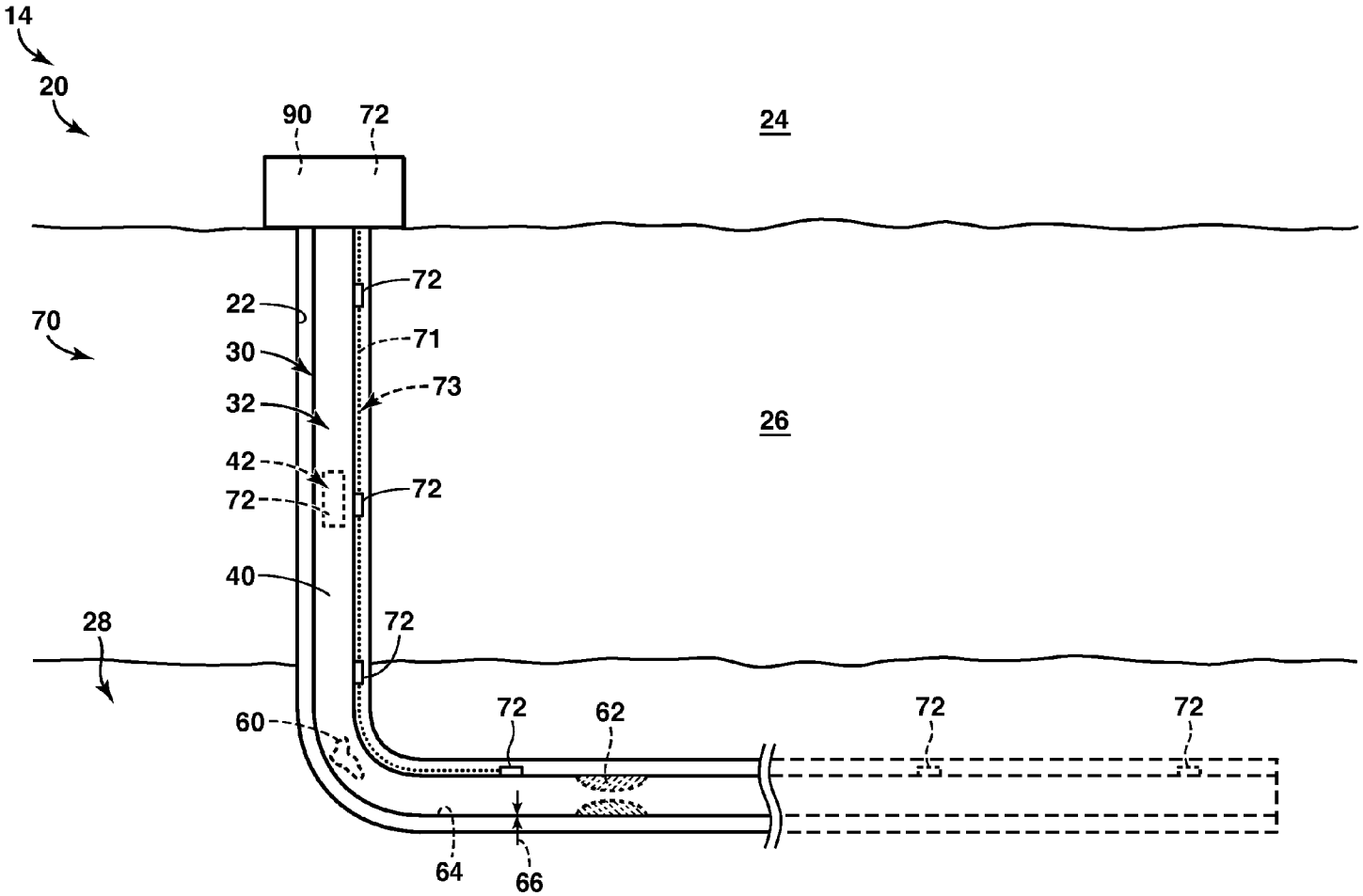
FIG. 1 is a schematic cross-sectional view of a hydrocarbon well that may include a tubular that may be utilized with the systems and methods according to the present disclosure.

FIGS. 1-6 provide examples of tubulars 30 according to the present disclosure, of hydrocarbon conveyance systems 14 that include tubulars 30, and/or of methods 100, 200, and/or 300 that utilize tubulars 30. Elements that serve a similar, or at least substantially similar, purpose are labeled with like numbers in each of FIGS. 1-6, and these elements may not be discussed in detail herein with reference to each of FIGS. 1-6. Similarly, all elements may not be labeled in each of FIGS. 1-6, but reference numerals associated therewith may be utilized herein for consistency. Elements, components, and/or features that are discussed herein with reference to one or more of FIGS. 1-6 may be included in and/or utilized with any of FIGS. 1-6 without departing from the scope of the present disclosure.

In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

Figure 2:
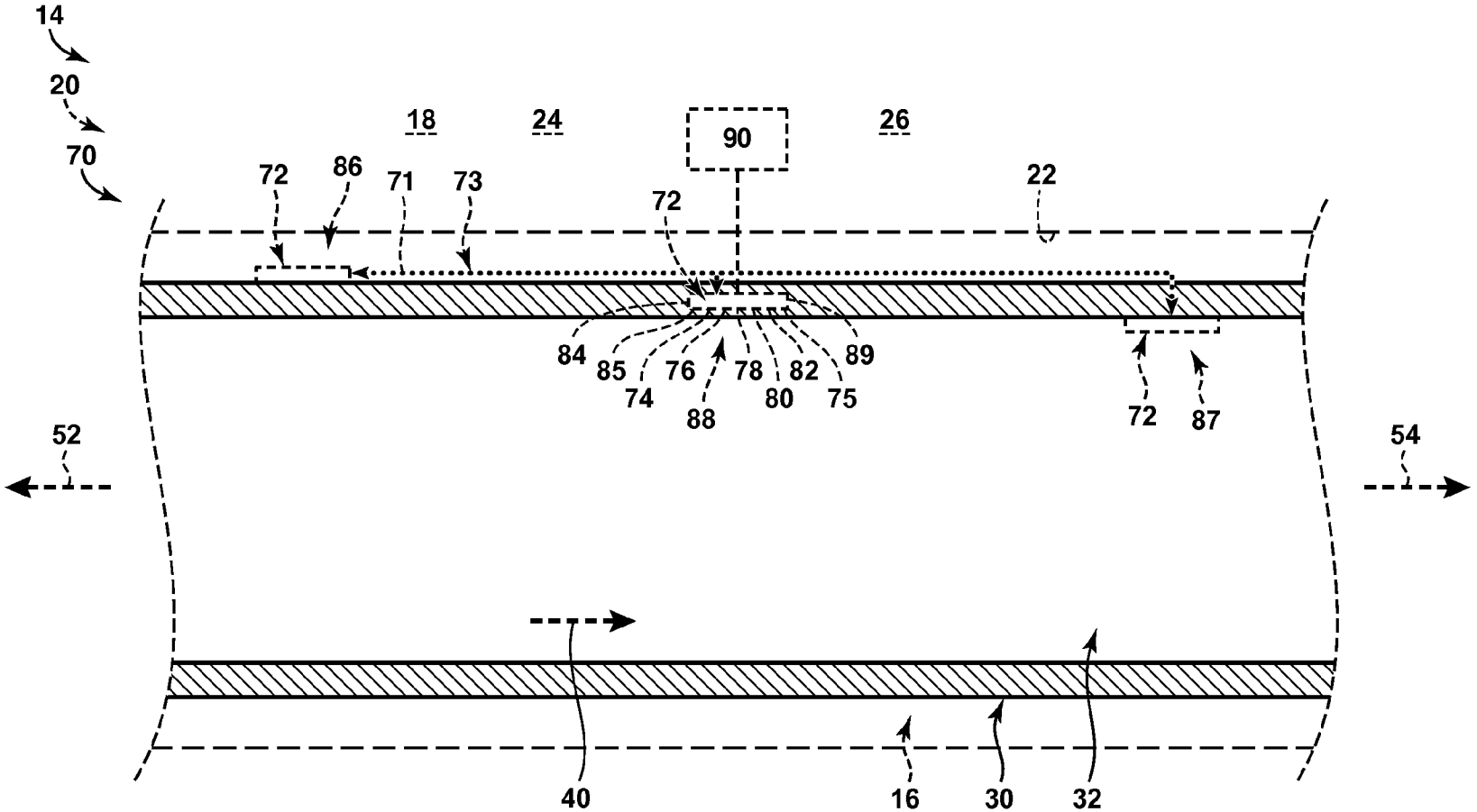
FIG. 2 is a schematic longitudinal cross-sectional view of a tubular that may be utilized with the systems and methods according to the present disclosure.
Figure 3:
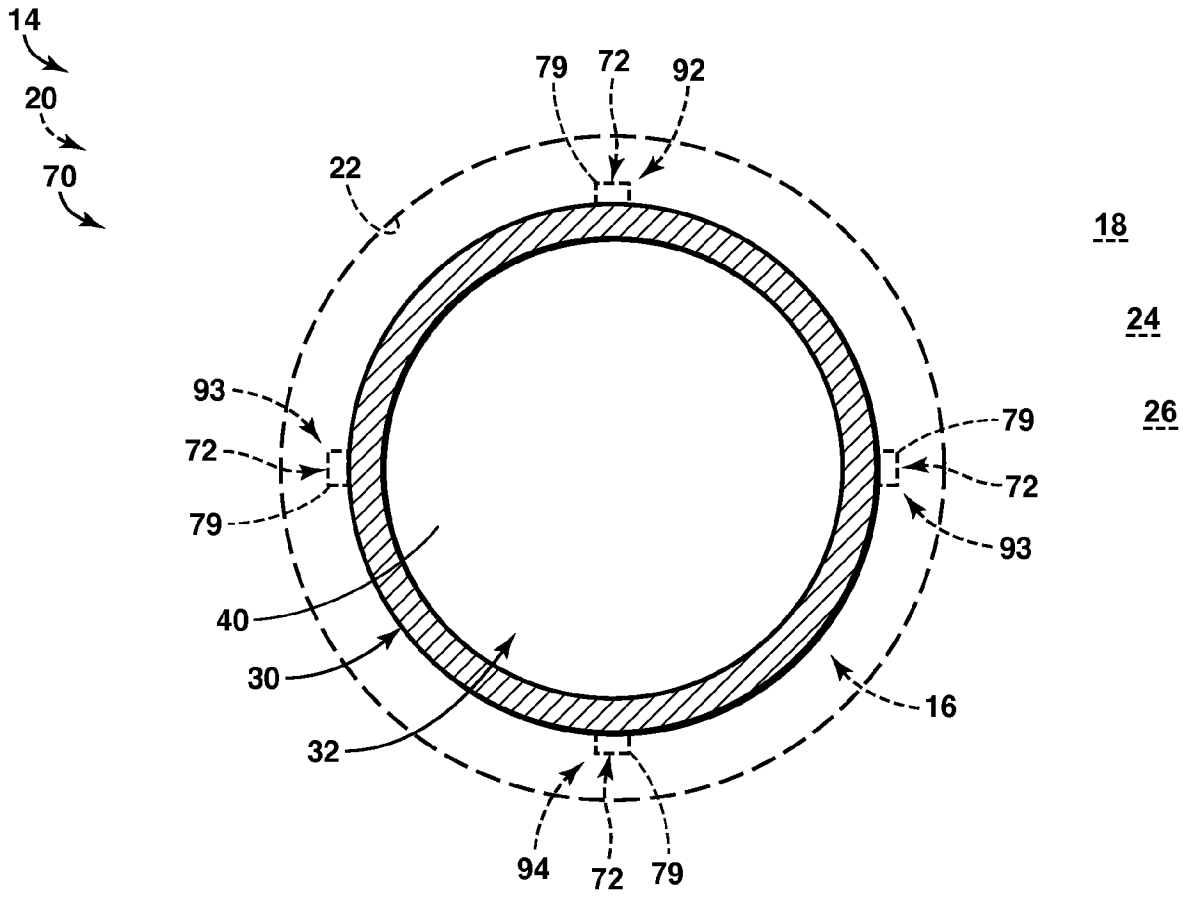
FIG. 3 is a schematic transverse cross-sectional view of a tubular that may be utilized with the systems and methods according to the present disclosure.

FIG. 1 is a schematic cross-sectional view of a hydrocarbon wellbore or conveyance system 14 such as may be utilized with the systems and methods according to the present disclosure. The hydrocarbon conveyance system is depicted in the form of a hydrocarbon well 20 that may include a tubular 30. FIGS. 2-3 provide more general views of a tubular 30 that may be utilized with hydrocarbon conveyance systems 14 according to the present disclosure. FIG. 2 illustrates a schematic longitudinal cross-sectional view of tubular 30, and FIG. 3 illustrates a schematic transverse cross-sectional view of tubular 30. Tubulars 30 of FIGS. 1-3 may define a tubular conduit 32 that is configured to convey a hydrocarbon fluid 40.

Hydrocarbon conveyance system 14 also may be referred to broadly herein as system 14. System 14 includes a communication network 70 that includes a plurality of communication nodes 72. The plurality of communication nodes 72 is spaced apart along tubular 30 and is configured to convey a data signal 71 between and/or via communication nodes 72. As an example, and as discussed herein, the data signal may be conveyed to and/or from a surface region 24.

System 14 further includes a controller 90. Controller 90 is in communication with communication network 70, such as via data signal 71, and is adapted, configured, designed, constructed, and/or programmed to communicate with and/or to control the operation of at least a portion of communication network 70 and/or of system 14. In general, controller 90 may be programmed to detect, determine, and/or monitor a condition of tubular 30, such as by utilizing communication network 70, by receiving, interpreting, modulating, and/or analyzing data signal 71 from communication network 70, and/or by transmitting data signal 71 to communication network 70. More specifically, controller 90 may be programmed to perform any suitable portion, or even all, of one or more of methods 100, 200, and/or 300, which are discussed in more detail herein. However, methods 100, 200, and/or 300 are not required to be performed by controller 90. As an example, a portion of methods 100, 200, and/or 300 may be performed by an operator who manually initiates, regulates, monitors, and/or controls the operation of system 14.

Controller 90 may include and/or be any suitable structure. As examples, controller 90 may include, be, and/or be referred to herein as a receiver that is configured to receive data signal 71, a transmitter that is configured to generate data signal 71, a monitor that is configured to display a data signal 71 (and/or a representation that is based upon data signal 71), a signal analyzer that is configured to analyze and/or interpret data signal 71, and/or a logic device, computer, and/or processor that is configured to make decisions based upon data signal 71.

Controller 90 further may be configured to generate a control signal, with this control signal being utilized to control the operation of communication network 70 and/or system 14. As an example, the control signal may be utilized to perform the initiating step of methods 100, although this is not required.

Controller 90 may determine and/or detect the condition of tubular 30 in any suitable manner. As an example, controller 90 may monitor propagation of data signal 71 between (adjacent) communication nodes 72 and/or may utilize information regarding the quality of propagation of data signal 71 and/or changes in the quality of propagation of data signal 71 to determine and/or detect the condition of tubular 30. Propagation of data signal 71 may be impacted and/or changed by the various materials and/or media that may be present within tubular conduit 32 and/or that may surround tubular 30, thereby permitting determination and/or detection of the condition of tubular 30.

As a more specific example, data signal 71 may include and/or be an acoustic wave that may be propagated and/or conveyed between adjacent communication nodes 72 in, within, and/or via tubular 30. Under these conditions, propagation of data signal 71 between nodes 72 may be impacted and/or changed by the condition of tubular 30. As an example, pits and/or cracks within tubular 30 may scatter the acoustic wave, thereby decreasing an intensity of the data signal that may be received by one node 72 from another node 72 and/or increasing a signal-to-noise ratio of the received data signal. As another example, the presence of a blockage material 62 within tubular conduit 32 (as illustrated in FIG. 1) may alter and/or change propagation characteristics of the acoustic wave, such as by absorbing and/or scattering a portion of the acoustic wave and/or by increasing attenuation of the acoustic wave. As yet another example, corrosion 64 of tubular 30 may produce and/or generate a thinned region 66, which may alter and/or change the propagation characteristics of the acoustic wave.

As another more specific example, one or more communication nodes 72 may include a tubular condition detector 84 (as illustrated in FIG. 2), and the tubular condition detector may be configured to detect the condition of tubular 30 and to convey the condition of tubular 30 to controller 90 via communication network 70. As an example, tubular condition detector 84 may be configured to detect a sound that may be generated by particulate material 60 contacting and/or eroding tubular 30 (as illustrated in FIG. 1). As additional examples, tubular condition detector 84 may be configured to detect the presence of blockage material 62, corrosion 64, and/or thinned region 66. As further examples, tubular condition detector 84 may be configured to detect a property of tubular 30, such as a temperature of tubular 30, a temperature of hydrocarbon fluid 40 within tubular conduit 32, a pressure of tubular 30, a pressure of hydrocarbon fluid 40 within tubular conduit 32, a sound wave that is propagated through tubular 30, a sound wave that is propagated through hydrocarbon fluid 40 within tubular conduit 32, a mechanical strain on tubular 30, and/or a flow speed of hydrocarbon fluid 40 within tubular conduit 32.

As illustrated in FIG. 1, tubular 30 may be a wellbore tubular 30 that extends within a wellbore 22. Wellbore 22 and/or wellbore tubular 30 may extend within a subterranean formation 28, which may be present within a subsurface region 26 and may extend between surface region 24 and the subterranean formation. However, this is not required. As an example, and as illustrated in FIGS. 2-3, tubular 30 additionally or alternatively may be, or include, a pipeline 16 that extends between a hydrocarbon fluid source 52 and a hydrocarbon fluid destination 54 (as illustrated in FIG. 2). Tubular 30 additionally or alternatively may be, or include, a subsea tubular 30 (or pipeline 16) that extends within a body of water and/or within a subsea region 18. Additionally or alternatively, tubular 30 may be, or include, a surface tubular 30 (or pipeline 16) that extends within surface region 24 and/or across, or along, a ground surface.

As illustrated in FIGS. 1-2, communication nodes 72 may be spaced apart along tubular 30 and may be configured for wired and/or wireless communication between adjacent communication nodes 72. As an example, communication nodes 72 may be spaced-apart by at least a minimum node-to-node separation distance. Examples of the minimum node-to-node separation distance include distances of at least 1 meter, at least 2.5 meters, at least 5 meters, at least 10 meters, at least 15 meters, or at least 20 meters.

Communication nodes 72 may be located along tubular 30 in any suitable manner. As an example, at least a portion of the plurality of communication nodes 72 may be operatively attached to tubular 30. As more specific examples, at least a portion of the plurality of communication nodes 72 may be operatively attached to an external surface of tubular 30 and/or external to tubular conduit 32 (as illustrated in FIG. 2 at 86) and/or operatively attached to an inner surface of tubular 30 (as illustrated in FIG. 2 at 87). As another example, at least a portion of the plurality of communication nodes 72 may be located within and/or may extend through tubular 30 (as illustrated in FIG. 2 at 88).

As yet another example, at least a portion of communication nodes 72 may be operatively attached to and/or form a portion of a downhole device 42 that may be present within tubular conduit 32 (as illustrated in FIG. 1). Examples of downhole device 42 include any suitable downhole tool, downhole logging device, sand control screen, autonomous device, wireline-attached device, tubing-attached device, casing collar, and/or inflow control device.

As illustrated in FIG. 3, communication nodes 72 also may have any suitable angular orientation, or distribution of angular orientations, about the transverse cross-section of tubular 30. As an example, and as indicated in FIG. 3 at 92, communication nodes 72 may be located at, or near, a top (or 12:00 position) of tubular 30. Under these conditions, communication nodes 72 may be proximal to and/or may detect buildup of hydrocarbon deposits, such as waxes and/or asphaltenes, that may be deposited within tubular conduit 32 from hydrocarbon fluid 40. As another example, and as indicated in FIG. 3 at 94, communication nodes 72 may be located at, or near, a bottom (or 6:00 position) of tubular 30. Under these conditions, communication nodes 72 may be proximal to and/or may detect buildup of scale and/or hydrates that may form on tubular 30 due to the presence of water therein. As yet another example, and as indicated in FIG. 3 at 93, communication nodes 72 may be located at, or near, the sides (3:00 or 9:00 position) of tubular 30. FIG. 3 schematically illustrates communication nodes 72 as being external to tubular conduit 32 and/or as being located on the external surface of tubular 30. However, it is within the scope of the present disclosure that communication nodes 72 of FIG. 3 may be located within tubular 30, may be located within tubular conduit 32, and/or may extend through tubular 30, as discussed herein with reference to FIG. 2.

The angular orientation of communication nodes 72 may be systematically and/or randomly varied along the length of tubular 30. In addition, any suitable number of communication nodes 72 may be located and/or present at any given location along the length of tubular 30. Furthermore, communication nodes 72 may include an angular orientation detector 79 that is configured to detect the angular orientation of a given communication node 72.

Communication nodes 72 may include any suitable structure and/or structures that may permit communication nodes 72 to generate data signal 71, to receive data signal 71, and/or to detect, determine, and/or infer any suitable property of tubular 30 and/or of hydrocarbon fluid 40 that may be indicative of the condition of tubular 30. As an example, and as illustrated in FIG. 2, communication nodes 72 may include a node transmitter 76 that may be configured to generate data signal 71, such as to transmit data signal 71 to an adjacent node 72 and/or to another node 72. As another example, communication nodes 72 additionally or alternatively may include a node receiver 78 that is configured to receive data signal 71, such as from an adjacent node 72 and/or from another node 72.

Node transmitter 76 and node receiver 78 may include and/or be any suitable structure and/or structures. As an example, node transmitter 76 may include a piezoelectric node transmitter that is configured to induce vibration in tubular 30, with this vibration being conveyed (as an acoustic wave) along tubular 30 as data signal 71. As another example, node receiver 78 may include a piezoelectric node receiver that is configured to receive the vibration from the tubular. Node transmitter 76 and node receiver 78 may be the same structure or separate, spaced-apart, structures.

Communication nodes 72 also may include additional structure and/or structures. As an example, communication nodes 72 may include an internal power source 74 that is configured to power the communication nodes. Examples of internal power source 74 include a battery, a high temperature battery, and/or a downhole power generation device.

As another example, communication nodes 72 may include a strain gauge 75. Strain gauge 75 may be configured to detect a strain on tubular 30 and/or on a housing that contains a given communication node 72. This strain may be indicative of an internal pressure within tubular 30.

As yet another example, communication nodes 72 also may include an electronic controller 85. Electronic controller 85 may be configured to control the operation of at least a portion of a given communication node 72. Electronic controller 85 may communicate with controller 90, such as to receive inputs therefrom and/or to transmit outputs thereto.

As another example, communication nodes 72 may include a sensor 80. Sensor 80 may be configured to sense and/or detect one or more properties of tubular 30, of tubular conduit 32, and/or of hydrocarbon fluid 40 and to convey a sensor signal that is indicative of the detected property to electronic controller 85.

As another example, communication nodes 72 may include and/or be in communication with tubular condition detector 84. Tubular condition detector 84 may be configured to convey a tubular condition signal that is indicative of the condition of tubular 30 to electronic controller 85. Tubular condition detector 84 may form a part of a communication node 72 or be spaced-apart from but in communication with communication nodes 72. When tubular condition detector 84 forms a part of communication node 72, communication node 72 also may be referred to herein as a detection node. Tubular condition detector 84 may be located within tubular conduit 32 and/or external to tubular conduit 32. Examples of tubular condition detector 84 include any suitable piezoelectric transmitter, piezoelectric receiver, sound transmitter, sound receiver, ultrasonic transmitter, ultrasonic receiver, pressure sensor, temperature sensor, and/or strain gauge.

As yet another example, communication nodes 72 may include an analog-to-digital converter 89. Analog-to-digital converter 89 may be configured to receive an analog signal from sensor 80 (such as the sensor signal) and/or from tubular condition detector 84 (such as the tubular condition signal) and to convert the analog signal to a digital signal, such as to permit electronic controller 85 to convey the digital signal as, or within, data signal 71.

As another example, communication nodes 72 also may include a memory device 82. Memory device 82 may be configured to store information within communication nodes 72 and to selectively convey the stored information within data signal 71. This may include storing the sensor signal and/or storing the tubular condition signal.

Data signal 71 may include and/or be any suitable signal that may be transmitted and/or propagated among and/or between communication nodes 72. As an example, communication network 70 may include and/or be a wireless communication network. Under these conditions, data signal 71 may include (or be transmitted as) a vibration, an acoustic wave, a radio wave, a low frequency electromagnetic wave, light, and/or a flexural wave that may be propagated via, or within, tubular 30 and/or hydrocarbon fluid 40. When data signal 71 is an acoustic wave, the acoustic wave may have any suitable frequency. As specific examples, the frequency of the acoustic wave may be between 90 and 110 kilohertz; however, the frequency of the acoustic wave may vary, such as between sonic frequencies and ultrasonic frequencies.

As another example, communication network 70 additionally or alternatively may include and/or be a wired communication network. Under these conditions, data signal 71 may include an electronic signal and/or an electric current that may be transmitted between respective communication nodes 72 via a data cable 73 that is separate from tubular 30.

Figure 4:
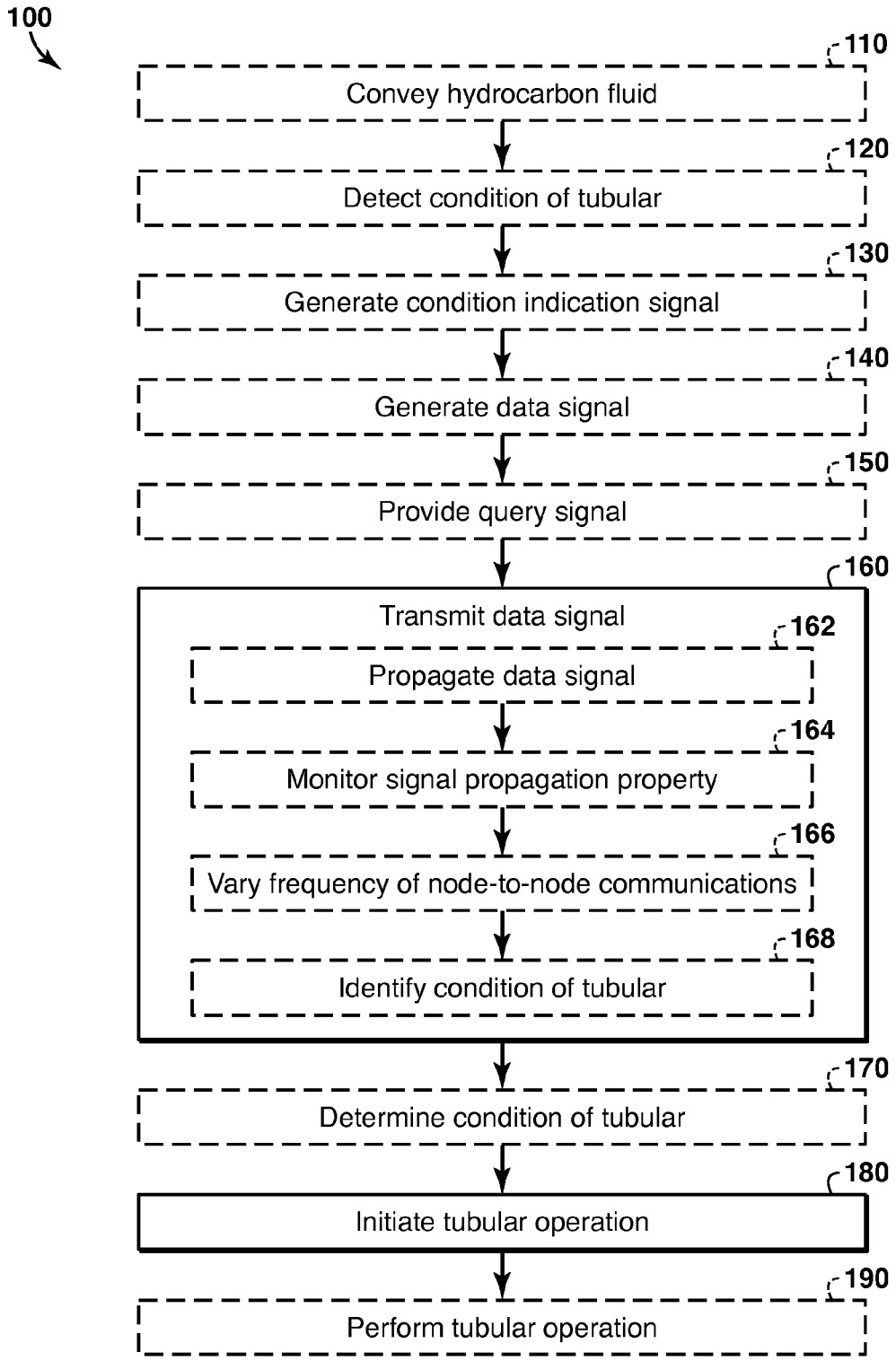
FIG. 4 is a flowchart depicting methods, according to the present disclosure, of monitoring a condition of a tubular that is configured to convey a hydrocarbon fluid.

FIG. 4 is a flowchart depicting methods 100, according to the present disclosure, of monitoring a condition of a tubular that defines a tubular conduit and is configured to convey a hydrocarbon fluid. Methods 100 may include conveying a hydrocarbon fluid at 110, detecting a condition of the tubular at 120, generating a condition indication signal at 130, generating a data signal at 140, and/or providing a query signal at 150. Methods 100 include transmitting the data signal at 160 and may include determining the condition of the tubular at 170. Methods 100 further include initiating a tubular operation at 180 and may include performing the tubular operation at 190.

Conveying the hydrocarbon fluid at 110 may include conveying the hydrocarbon fluid within the tubular conduit. This may include conveying the hydrocarbon fluid along a length of the tubular conduit and/or conveying the hydrocarbon fluid between a hydrocarbon fluid source and a hydrocarbon fluid destination.

The conveying at 110 may include systematically, periodically, and/or selectively varying a flow rate of the hydrocarbon fluid within the tubular conduit. The varying may improve determination of the condition of the tubular, such as to improve a quality of data collected during, or a signal-to-noise ratio of, the detecting at 120 and/or the determining at 170.

Detecting the condition of the tubular at 120 may include detecting the condition of the tubular with a tubular condition detector. Examples of the tubular condition detector are disclosed herein. The tubular condition detector may be configured to detect a property of the tubular (or of a portion of the tubular) that is proximal to the tubular condition detector. Examples of the property of the tubular include a temperature of the tubular, a temperature of the hydrocarbon fluid within the tubular conduit, a pressure of the tubular, a pressure of the hydrocarbon fluid within the tubular conduit, a sound wave that is propagated by and/or through the tubular, a sound wave that is propagated by and/or through the hydrocarbon fluid within the tubular conduit, a mechanical strain on the tubular, and/or a flow speed of the hydrocarbon fluid within the tubular conduit.

Another example of the property of the tubular includes a thickness of a wall of the tubular. Yet another example of the property of the tubular includes a sound level of a sound that is generated by abrasion of the tubular by particulate material that is entrained within the conveyed hydrocarbon fluid. Another example of the property of the tubular includes a pressure difference between nodes of a communication network, such as between a given node of a plurality of communication nodes that extends along the tubular and another node of the plurality of communication nodes. This pressure difference may be indicative of accumulation of blockage material within the tubular conduit.

Generating the condition indication signal at 130 may include generating any suitable condition indication signal that may be indicative of the condition of the tubular and may be accomplished in any suitable manner. As an example, the generating at 130 may include generating the condition indication signal with the tubular condition detector. As another example, the generating at 140 may be based, at least in part, on the condition indication signal. As such, the data signal may be based, at least in part, on the condition indication signal and/or may be configured to convey, transmit, and/or propagate the condition indication signal along the tubular.

Generating the data signal at 140 may include generating the data signal in any suitable manner. As an example, the generating at 140 may include generating the data signal with the communication network and/or with one or more of the communication nodes of the communication network. As another example, the generating at 140 may include generating the data signal with a data signal source that is operatively affixed to the tubular.

Providing the query signal at 150 may include providing any suitable query signal to any suitable portion of the communication network to initiate the transmitting at 160. As an example, the transmitting at 160 may include transmitting the data signal from an initiation point to a data collection point via at least a portion of the plurality of communication nodes, and the providing at 150 may include providing the query signal from the data collection point to the initiation point.

Transmitting the data signal at 160 may include transmitting, along the tubular, any suitable data signal that is indicative of the condition of the tubular. The data signal may be transmitted along the tubular with, or via, the communication network and/or with, or via, the plurality of communication nodes of the communication network. The data signal may include real-time data regarding the condition of the tubular. Additionally or alternatively, the data signal may include and/or be log data that is indicative of the condition of the tubular and stored by at least a portion of the plurality of communication nodes and transmitted via the data signal. Under these conditions, the log data may be transmitted responsive to receipt of the query signal by a respective communication node.

The transmitting at 160 may be utilized to determine the condition of the tubular. As an example, each communication node of the plurality of communication nodes may be configured to receive an input data signal and to generate an output data signal that is based, at least in part, on the input data signal. Under these conditions, the transmitting at 160 may include propagating the data signal along the tubular via a plurality of node-to-node communications among the plurality of communication nodes, as indicated in FIG. 4 at 162. Each of the plurality of node-to-node communications may include transmission of a respective output data signal by a given communication node of the plurality of communication nodes and receipt of the respective output data signal, as a respective input data signal, by another communication node of the plurality of communication nodes.

The transmitting at 160 further may include monitoring a signal propagation property of the plurality of node-to-node communications of the data signal, as indicated in FIG. 4 at 164. The signal propagation property may be indicative of the condition of the tubular. Under these conditions, the initiating at 180 may include initiating responsive to the signal propagation property indicating that the tubular is outside a predetermined condition range. Examples of the signal propagation property include a signal attenuation of one or more of the plurality of node-to-node communications, a signal scattering of one or more of the plurality of node-to-node communications, a signal-to-noise ratio of one or more of the plurality of node-to-node communications, and/or a signal amplitude of one or more of the plurality of node-to-node communications.

The transmitting at 160 further may include varying a frequency of the plurality of node-to-node communications, as indicated in FIG. 4 at 166. This may include varying the frequency in a predetermined, preselected, and/or specified manner and may be performed to increase a sensitivity of the signal propagation property to the condition of the tubular. As an example, a first frequency, or frequency range, may be utilized to monitor and/or detect a signal propagation property that is indicative of thinning of the tubular. As another example, a second frequency, or frequency range, may be utilized to monitor and/or detect buildup of a blockage material within the tubular conduit. As a more specific example, relatively lower frequencies may be utilized to detect scale and/or buildup within the tubular conduit, while relatively higher frequencies may be utilized to detect localized defects (such as thinning and/or pinholes) within the tubular.

The transmitting at 160 also may include identifying the condition of the tubular and/or of specific portion(s) of the tubular, as indicated in FIG. 4 at 168. As an example, each of the plurality of node-to-node communications may include a respective identification dataset. The respective identification dataset may uniquely identify (or may be utilized to uniquely identify) a respective portion of the tubular over which a corresponding node-to-node communication is propagated. Under these conditions, the identifying at 168 may include identifying a condition of the respective portion of the tubular based, at least in part, on the signal propagation property of the corresponding node-to-node communication. Additionally or alternatively, the identifying at 168 also may include identifying the condition of the respective portion of the tubular based, at least in part, on a comparison between the signal propagation property of the corresponding node-to-node communication with the signal propagation property of another node-to-node communication of the plurality of node-to-node communications. Additionally or alternatively, the identifying at 168 may include identifying the condition of the respective portion of the tubular based, at least in part, on a change in the signal propagation property of the corresponding node-to-node communication with time.

As discussed, the transmitting at 160 may include transmitting the data signal from the initiation point to the data collection point via at least a portion of the plurality of communication nodes. Under these conditions, the initiation point may be spaced apart from the data collection point. Examples of the initiation point include a communication node of the plurality of communication nodes, an initiating communication node of the plurality of communication nodes, a data collection node of the plurality of communication nodes, and/or a tubular condition detector.

The data collection point may include any suitable structure. As an example, the data collection point may include a logging device that is conveyed within the tubular conduit. Under these conditions, methods 100 further may include conveying the logging device within the tubular conduit. Examples of the logging device include an autonomous logging device, a surface-attached logging device, a wireline-attached logging device, and/or a tubing-attached logging device.

As discussed, the tubular may be located in, may be present in, and/or may convey the hydrocarbon fluid through any suitable environment. As an example, the tubular may include and/or be a wellbore tubular that extends within a subterranean formation. Under these conditions, the transmitting at 160 may include transmitting the data signal along a portion of the tubular that extends within the subterranean formation and/or transmitting the data signal within the subterranean formation. As another example, the wellbore tubular may extend between a surface region and the subterranean formation. Under these conditions, the transmitting at 160 may include transmitting the data signal from the surface region to the subterranean formation, from the subterranean formation to the surface region, and/or between the subterranean formation and the surface region.

As yet another example, the tubular may include and/or be a pipeline that extends across a ground surface between the hydrocarbon fluid source and the hydrocarbon fluid destination. Under these conditions, the transmitting at 160 may include transmitting the data signal at least partially (or even completely) between the hydrocarbon fluid source and the hydrocarbon fluid destination. As another example, the tubular may include and/or be a subsea tubular that extends within a body of water. Under these conditions, the transmitting at 160 may include transmitting the data signal along a portion of the tubular that extends within the body of water and/or transmitting the data signal within the body of water.

Determining the condition of the tubular at 170 may include determining the condition of the tubular in any suitable manner. The determining at 170 may be based, at least in part, on the data signal. As an example, the determining at 170 may include determining the condition of the tubular based, at least in part, on a given and/or instantaneous value of the data signal. As another example, the determining at 170 also may include determining based, at least in part, on a temporal and/or chronological change in the data signal. As yet another example, the determining at 170 may include determining based, at least in part, on the signal propagation property of the data signal.

The determining at 170 may include determining, establishing, estimating, and/or quantifying any suitable condition and/or state of the tubular. As examples, the determining at 170 may include determining that the tubular is corroded by more than a threshold corrosion amount, determining that an undesired hole extends through a wall of the tubular, and/or determining that a thickness of the wall of the tubular is less than a threshold wall thickness. As additional examples, the determining at 170 also may include determining that a flow of the hydrocarbon fluid through the tubular conduit is restricted by greater than a threshold flow restriction and/or determining that a minimum cross-sectional area of the tubular conduit is less than a threshold cross-sectional area. As another example, the determining at 170 may include determining that the tubular has greater than a threshold thickness of a blockage material built up within the tubular conduit. Examples of the blockage material include a wax, a scale, an asphaltene, and/or a hydrate.

Initiating the tubular operation at 180 may include initiating any suitable tubular operation and may be performed responsive to the data signal indicating that the condition of the tubular is outside the predetermined condition range. Examples of the tubular operation include inspection of the tubular and/or conveyance of an inspection tool within the tubular. Additional examples of the tubular operation include release of a pig into the tubular conduit, release of a chemical into the tubular conduit, repair of a portion of the tubular, and/or replacement of a portion of the tubular.

Performing the tubular operation at 190 may include performing any suitable tubular operation. The performing at 190 may be executed responsive to, or as a result of, the initiating at 180. Examples of the tubular operation are discussed herein with reference to the initiating at 180.

Figure 5:
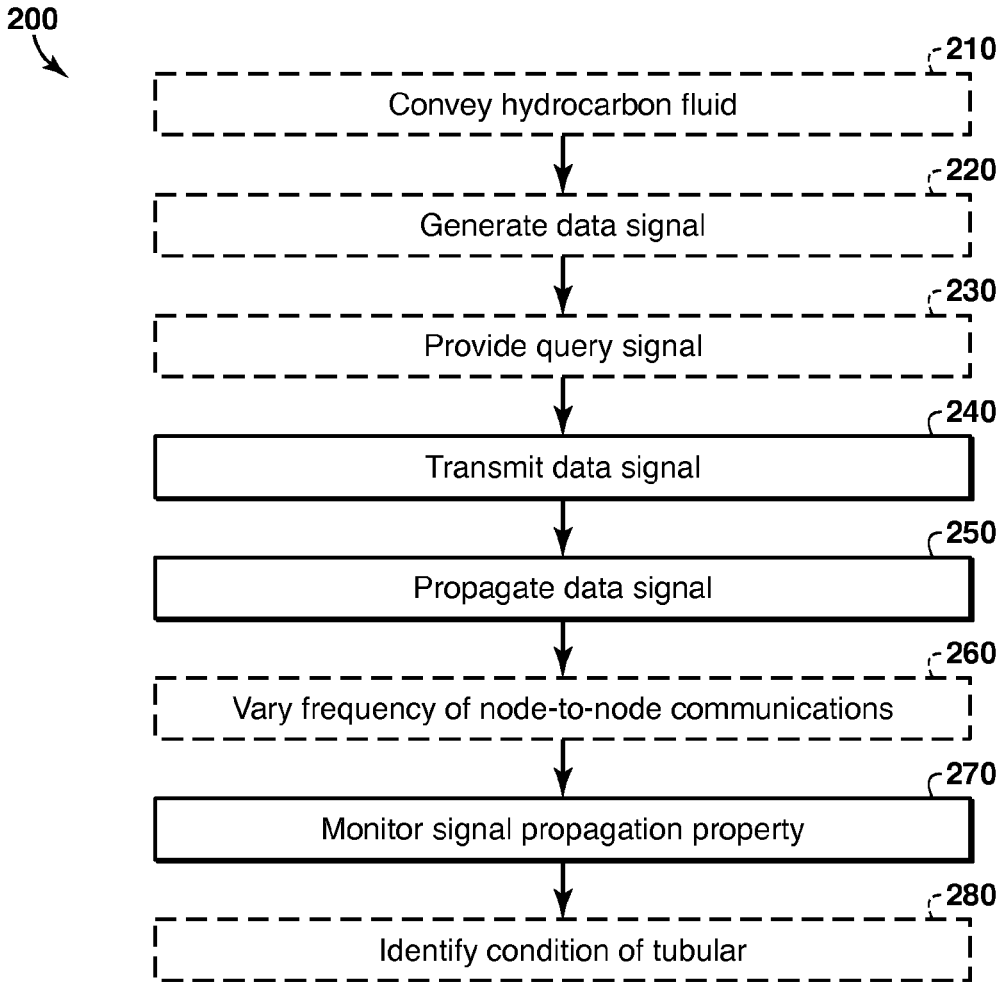
FIG. 5 is a flowchart depicting methods, according to the present disclosure, of monitoring a condition of a tubular that is configured to convey a hydrocarbon fluid.

FIG. 5 is a flowchart depicting methods 200, according to the present disclosure, of monitoring a condition of a tubular that defines a tubular conduit and is configured to convey a hydrocarbon fluid. Methods 200 may include conveying a hydrocarbon fluid at 210, generating a data signal at 220, and/or providing a query signal at 230. Methods 200 include transmitting the data signal at 240 and propagating the data signal at 250 and may include varying a frequency of node-to-node communications at 260. Methods 200 further include monitoring a signal propagation property at 270 and may include identifying the condition of the tubular at 280.

The conveying at 210 may be at least substantially similar to the conveying at 110, which is discussed herein with reference to methods 100 of FIG. 4. The generating at 220 may be at least substantially similar to the generating at 140, which is discussed herein with reference to methods 100 of FIG. 4. The providing at 230 may be at least substantially similar to the providing at 150, which is discussed herein with reference to methods 100 of FIG. 4.

The transmitting at 240 may include transmitting the data signal along the tubular with a communication network that includes a plurality of communication nodes. Each communication node of the plurality of communication nodes may be configured to receive an input data signal and to generate an output data signal that is based, at least in part, on the input data signal. The transmitting at 240 further may be at least substantially similar to the transmitting at 160, which is discussed herein with reference to methods 100 of FIG. 4.

The propagating at 250 may include propagating the data signal along the tubular via a plurality of node-to-node communications among the plurality of communication nodes. Each of the plurality of node-to-node communications may include transmission of a respective output data signal by a given communication node of the plurality of communication nodes and receipt of the respective output data signal, as a respective input data signal, by another communication node of the plurality of communication nodes. The propagating at 250 further may be at least substantially similar to the propagating at 162, which is discussed herein with reference to methods 100 of FIG. 4.

The varying at 260 may be at least substantially similar to the varying at 166, which is discussed herein with reference to methods 100 of FIG. 4. The monitoring at 270 may include monitoring any suitable signal propagation property of the plurality of node-to-node communications of the data signal. The signal propagation property may be indicative of the condition of the tubular. The monitoring at 270 further may be at least substantially similar to the monitoring at 164, which is discussed herein with reference to methods 100 of FIG. 4. The identifying at 280 may be at least substantially similar to the identifying at 168, which is discussed herein with reference to methods 100 of FIG. 4.

Figure 6:
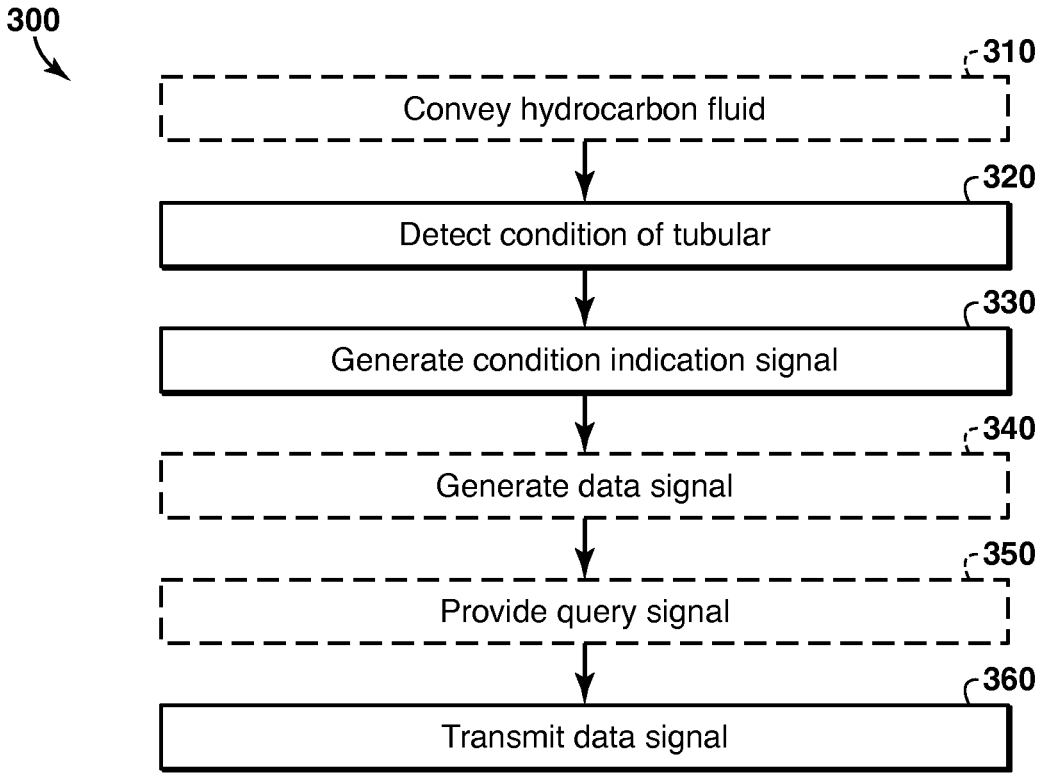
FIG. 6 is a flowchart depicting methods, according to the present disclosure, of monitoring a condition of a tubular that is configured to convey a hydrocarbon fluid.

FIG. 6 is a flowchart depicting methods 300, according to the present disclosure, of monitoring a condition of a tubular that defines a tubular conduit and is configured to convey a hydrocarbon fluid. Methods 300 may include conveying a hydrocarbon fluid at 310 and include detecting a condition of the tubular at 320 and generating a condition indication signal at 330. Methods 300 further may include generating a data signal at 340 and/or providing a query signal at 350, and methods 300 include transmitting the data signal at 360.

The conveying at 310 may be at least substantially similar to the conveying at 110, which is discussed herein with reference to methods 100 of FIG. 4. The detecting at 320 may include detecting the condition of the tubular with a tubular condition detector. The detecting at 320 further may be at least substantially similar to the detecting at 120, which is discussed herein with reference to methods 100 of FIG. 4.

The generating at 330 may include generating any suitable condition indication signal with the tubular condition detector. The condition indication signal may be indicative of the condition of the tubular. The generating at 330 further may be at least substantially similar to the generating at 130, which is discussed herein with reference to methods 100 of FIG. 4.

The generating at 340 may be at least substantially similar to the generating at 140, which is discussed herein with reference to methods 100 of FIG. 4. The providing at 350 may be at least substantially similar to the providing at 150, which is discussed herein with reference to methods 100 of FIG. 4.

The transmitting at 360 may include transmitting the data signal along the tubular with a communication network. The data signal may be based, at least in part, on the condition indication signal. The communication network may include a plurality of communication nodes, and the transmitting at 360 may include transmitting, or propagating, the data signal among and/or via the plurality of communication nodes. The transmitting at 360 further may be at least substantially similar to the transmitting at 160, which is discussed herein with reference to methods 100 of FIG. 4.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a controller (such as controller 85 and/or controller 90), computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or"

clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of monitoring a condition of a tubular that defines a tubular conduit, the method comprising:

transmitting a data signal along the tubular with a communication network that includes a plurality of communication nodes;

comparing a transmission quality of the transmitted data signal between a first pair of the plurality of communication nodes and a second pair of the plurality of communication nodes;

determining the condition of the tubular based, at least in part, on the compared transmission quality of the transmitted data signal;

wherein the determining includes at least one of:

(i) determining that the tubular is corroded more than a threshold corrosion amount;

(ii) determining that an undesired hole extends through a wall of the tubular;

(iii) determining that a thickness of the wall of the tubular is less than a threshold wall thickness;

(iv) determining that a minimum cross-sectional area of the tubular conduit is less than a threshold cross-sectional area; and initiating a tubular operation responsive to the data signal indicating that the condition of the tubular is outside a predetermined condition range.

2. The method of claim 1, wherein the tubular operation includes at least one of:

(i) release of a pig into the tubular conduit;

(ii) release of a chemical into the tubular conduit;

(iii) repair of a portion of the tubular;

(iv) replacement of a portion of the tubular;

(v) inspection of the tubular; and (vi) conveyance of an inspection tool within the tubular conduit.

3. The method of claim 1, wherein the method further includes performing the tubular operation.

4. The method of claim 1, wherein the method further includes:

detecting the condition of the tubular with a tubular condition detector; and generating a condition indication signal with the tubular condition detector, wherein the condition indication signal is indicative of the condition of the tubular, and further wherein the data signal is based, at least in part, on the condition indication signal.

5. The method of claim 1, wherein each communication node of the plurality of communication nodes is configured to:

(i) receive an input data signal; and (ii) generate an output data signal that is based, at least in part, on the input data signal; wherein the transmitting includes propagating the data signal along the tubular via a plurality of node-to-node communications among the plurality of communication nodes, wherein each of the plurality of node-to-node communications includes transmission of a respective output data signal by a given communication node of the plurality of communication nodes and receipt of the respective output data signal, as a respective input data signal, by another communication node of the plurality of communication nodes; and further wherein the method includes:

monitoring a signal propagation property of the plurality of node-to-node communications of the data signal that is indicative of the condition of the tubular, wherein the initiating includes initiating responsive to the signal propagation property indicating that the condition of the tubular is outside the predetermined condition range.

6. The method of claim 1, wherein the determining includes determining based upon at least one of:

(i) a given value of the data signal; and (ii) a temporal change in the data signal.

7. The method of claim 1, wherein the method further includes generating the data signal, wherein the generating the data signal includes at least one of:

(i) generating with the communication network;

(ii) generating with a communication node of the plurality of communication nodes; and (iii) generating with a data signal source that is operatively affixed to the tubular.

8. A hydrocarbon fluid conveyance system, comprising:

a tubular that is configured to convey hydrocarbon fluid;

a communication network including a plurality of communication nodes for transmitting a data signal along the tubular, wherein the plurality of communication nodes is spaced apart along the tubular; and a controller programmed to control operation of the communication network, to determine a condition of the tubular based at least in part on the transmitted data signal by comparing a transmission quality of the transmitted data signal between a first pair of the plurality of communication nodes and a second pair of the plurality of communication nodes, based, at least in part, on the compared transmission quality of the transmitted data signal; and the controller programmed also to initiate a tubular operation responsive to the data signal indicating that the condition of the tubular is outside a predetermined condition range wherein the determining includes at least one of:

(i) determining that the tubular is corroded more than a threshold corrosion amount;

(ii) determining that an undesired hole extends through a wall of the tubular;

(iii) determining that a thickness of the wall of the tubular is less than a threshold wall thickness;

(iv) determining that a minimum cross-sectional area of the tubular conduit is less than a threshold cross-sectional area.

9. A method of monitoring a condition of a tubular that defines a tubular conduit, the method comprising:

transmitting a data signal along the tubular with a communication network that includes a plurality of communication nodes, wherein each communication node of the plurality of communication nodes is configured to:

(i) receive an input data signal;

(ii) monitoring a signal propagation property of the plurality of node-to-node communications of the data signal that is indicative of the condition of the tubular by comparing a transmission quality of the monitored signal propagation property between a first pair of the plurality of communication nodes and a second pair of the plurality of communication nodes;

determining the condition of the tubular based, at least in part, on the compared transmission quality of the monitored signal propagation property between a first pair of the plurality of communication nodes and a second pair of the plurality of communication nodes; and (iii) generate an output data signal that is based, at least in part, on the input data signal; wherein the transmitting includes propagating the data signal along the tubular via a plurality of node-to-node communications among the plurality of communication nodes, wherein each of the plurality of node-to-node communications includes transmission of a respective output data signal by a given communication node of the plurality of communication nodes and receipt of the respective output data signal, as a respective input data signal, by another communication node of the plurality of communication nodes;

wherein determining the condition of the tubular is based, at least in part, on the data signal;

wherein the determining includes at least one of:

(i) determining that the tubular is corroded more than a threshold corrosion amount;

(ii) determining that an undesired hole extends through a wall of the tubular;

(iii) determining that a thickness of the wall of the tubular is less than a threshold wall thickness;

(iv) determining that a minimum cross-sectional area of the tubular conduit is less than a threshold cross-sectional area.

10. The method of claim 9, wherein the signal propagation property includes at least one of:

(i) a signal attenuation of the plurality of node-to-node communications;

(ii) a signal scattering of the plurality of node-to-node communications;

(iii) a signal-to-noise ratio of the plurality of node-to-node communications; and (iv) a signal amplitude of the plurality of node-to-node communications.

11. The method of claim 9, wherein the method further includes varying a frequency of the plurality of node-to-node communications in a predetermined manner.

12. The method of claim 11, wherein the varying the frequency includes varying the frequency to increase sensitivity of the signal propagation property to the condition of the tubular.

13. The method of claim 9, wherein each of the plurality of node-to-node communications includes a respective identification dataset, wherein the respective identification dataset uniquely identifies a respective portion of the tubular over which a corresponding node-to-node communication is propagated, and further wherein the method includes at least one of:

(i) identifying a condition of the respective portion of the tubular based, at least in part, on the signal propagation property of the corresponding node-to-node communication; and (ii) identifying the condition of the respective portion of the tubular based, at least in part, on a comparison of the signal propagation property of the corresponding node-to-node communication to the signal propagation property of another node-to-node communication of the plurality of node-to-node communications.

14. The method of claim 9, wherein the determining includes determining based upon at least one of: (i) a given value of the data signal; and (ii) a temporal change in the data signal.

15. The method of claim 9, wherein the method further includes generating the data signal, wherein the generating the data signal includes at least one of:

(i) generating with the communication network;

(ii) generating with a communication node of the plurality of communication nodes; and (iii) generating with a data signal source that is operatively affixed to the tubular.

16. The method of claim 9, wherein the method further includes conveying the hydrocarbon fluid within the tubular conduit, and further wherein the method includes systematically varying a flow rate of the hydrocarbon fluid within the tubular conduit to at least partially determine the condition of the tubular.

17. A method of monitoring a condition of a tubular that defines a tubular conduit, the method comprising:

detecting a condition of the tubular with a tubular condition detector wherein the tubular condition detector includes a detection node of the plurality of communication nodes, generating a condition indication signal with the tubular condition detector, wherein the condition indication signal is indicative of the condition of the tubular;

transmitting a data signal along the tubular with a communication network that includes a plurality of communication nodes, wherein the data signal is based, at least in part, on the condition indication signal; and determining the condition of the tubular based, at least in part, on the transmitted data signal wherein the determining includes at least one of:

(i) determining that the tubular is corroded more than a threshold corrosion amount;

(ii) determining that an undesired hole extends through a wall of the tubular;

(iii) determining that a thickness of the wall of the tubular is less than a threshold wall thickness;

and (iv) determining that a minimum cross-sectional area of the tubular conduit is less than a threshold cross-sectional area.

18. The method of claim 17, wherein the tubular condition detector is configured to detect a property of a portion of the tubular that is proximate the tubular condition detector.

19. The method of claim 18, wherein the property of the portion of the tubular includes at least one of a temperature of the tubular, a temperature of the hydrocarbon fluid within the tubular conduit, a pressure of the portion of the tubular, a pressure of the hydrocarbon fluid within the tubular conduit, a sound wave that is propagated through the portion of the tubular, a sound wave that is propagated through the hydrocarbon fluid within the tubular conduit, a mechanical strain on the portion of the tubular, and a flow speed of the hydrocarbon fluid within the tubular conduit.

20. The method of claim 18, wherein the property of the portion of the tubular includes a thickness of a wall of the tubular.

21. The method of claim 18, wherein the property of the portion of the tubular includes a sound level of a sound generated by abrasion of the tubular by particulate material that is entrained within conveyed hydrocarbon fluid.

22. The method of claim 17, wherein the tubular condition detector is separate from the plurality of communication nodes and in communication with the plurality of communication nodes.

23. The method of claim 17, wherein the tubular condition detector extends within the tubular conduit.

24. The method of claim 17, wherein the tubular condition detector is external to the tubular conduit.

25. The method of claim 17, wherein the tubular condition detector includes at least one of:

(i) a piezoelectric transmitter;

(ii) a piezoelectric receiver;

(iii) a sound transmitter;

(iv) a sound receiver;

(v) an ultrasonic transmitter;

(vi) an ultrasonic receiver;

(vii) a pressure sensor;

(viii) a temperature sensor; and (ix) a strain gauge.

26. The method of claim 17, wherein the tubular condition detector is configured to determine a pressure difference between a given node of the plurality of communication nodes and another node of the plurality of communication nodes.

27. The method of claim 17, wherein the transmitting includes transmitting log data that is stored by at least a portion of the plurality of communication nodes, wherein the log data is indicative of the condition of the tubular.

* * * * *